US010658141B2

(12) United States Patent
Murakoshi et al.

(10) Patent No.: US 10,658,141 B2
(45) Date of Patent: May 19, 2020

(54) ELECTROMAGNETIC RELAY

(71) Applicant: FUJITSU COMPONENT LIMITED, Tokyo (JP)

(72) Inventors: Takuji Murakoshi, Tokyo (JP); Kazuo Kubono, Tokyo (JP); Daiei Iwamoto, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 148 days.

(21) Appl. No.: 15/699,397

(22) Filed: Sep. 8, 2017

(65) Prior Publication Data

US 2018/0096810 A1 Apr. 5, 2018

(30) Foreign Application Priority Data

Oct. 5, 2016 (JP) ..... 2016-197511

(51) Int. Cl.
*H01H 3/00* (2006.01)
*H01H 50/58* (2006.01)
(Continued)

(52) U.S. Cl.
CPC ..... *H01H 50/58* (2013.01); *H01H 9/443* (2013.01); *H01H 50/02* (2013.01); *H01H 50/28* (2013.01);
(Continued)

(58) Field of Classification Search
CPC ..... H01H 50/02; H01H 50/36; H01H 50/58
(Continued)

(56) References Cited

U.S. PATENT DOCUMENTS 4,388,757 A 6/1983 Takeyama et al.
4,954,924 A * 9/1990 Haragashira ..... G01R 33/3621 335/131
(Continued)

FOREIGN PATENT DOCUMENTS

CN 102820172 12/2012
CN 102820172 A 12/2012
(Continued)

OTHER PUBLICATIONS

WIPO English Abstract for Chinese Publication No. 1029158890, published Feb. 6, 2013.
(Continued)

*Primary Examiner* — Shawki S Ismail
*Assistant Examiner* — Lisa N Homza
(74) *Attorney, Agent, or Firm* — Staas & Halsey LLP

(57) ABSTRACT

An electromagnetic relay including: an electromagnet; a movable spring having a movable contact; a first terminal to which one end of the movable spring is connected; a second terminal having a fixed contact opposite to the movable contact; an actuator that rotates by excitation of the electromagnet, rotates the movable spring, and causes the movable contact to come in contact with the fixed contact or to separate from the fixed contact; a nonmagnetic card to be attached to the actuator; a plurality of magnetic members that sandwich the movable contact and the fixed contact, and apply a magnetic flux to the movable contact and the fixed contact to extend an arc; and a permanent magnet attached between the magnetic members.

5 Claims, 10 Drawing Sheets

(51) Int. Cl.

| | |
|---|---|
| ***H01H 50/28*** | (2006.01) |
| ***H01H 51/22*** | (2006.01) |
| ***H01H 9/44*** | (2006.01) |
| ***H01H 50/02*** | (2006.01) |
| ***H01H 50/36*** | (2006.01) |
| *H01H 1/58* | (2006.01) |

(52) U.S. Cl.
CPC ..... *H01H 50/36* (2013.01); *H01H 51/2227* (2013.01); *H01H 2001/5877* (2013.01)

(58) Field of Classification Search
USPC ..... 335/189
See application file for complete search history.

(56) References Cited

U.S. PATENT DOCUMENTS

| | | | | |
|---|---|---|---|---|
| 6,046,660 | A * | 4/2000 | Gruner | H01H 50/546 335/128 |
| 6,075,429 | A * | 6/2000 | Uotome | H01H 9/443 335/129 |
| 7,659,800 | B2 * | 2/2010 | Gruner | H01H 1/26 335/185 |
| 8,008,999 | B2 * | 8/2011 | Morimura | H01H 51/2227 335/129 |
| 8,519,808 | B2 * | 8/2013 | Morimura | H01H 9/36 335/78 |
| 8,659,372 | B2 * | 2/2014 | Morimura | H01H 50/02 335/201 |
| 2010/0039195 | A1 | 2/2010 | Morimura | |
| 2011/0115586 | A1 | 5/2011 | Morimura | |
| 2012/0313737 | A1 | 12/2012 | Iwamoto et al. | |
| 2013/0033344 | A1 | 2/2013 | Morimura | |
| 2013/0113581 | A1 | 5/2013 | Kakimoto et al. | |
| 2013/0285774 | A1 | 10/2013 | Haseqawa et al. | |
| 2014/0232489 | A1 | 8/2014 | Kubono et al. | |
| 2015/0325398 | A1 | 11/2015 | Nakahara et al. | |
| 2017/0133183 | A1 | 5/2017 | Hasegawa et al. | |

FOREIGN PATENT DOCUMENTS

| | | |
|---|---|---|
| CN | 102915880 | 2/2013 |
| CN | 103377856 | 10/2013 |
| CN | 103907169 | 7/2014 |
| CN | 205230962 | 5/2016 |
| EP | 2 533 262 A1 | 12/2012 |
| EP | 2 763 153 A1 | 8/2014 |
| JP | 2010-44973 | 2/2010 |
| JP | 2011-108452 | 6/2011 |
| JP | 2012-199113 | 10/2012 |
| JP | 2013-37775 | 2/2013 |
| JP | 2013-98126 | 5/2013 |
| JP | 2014-63675 | 4/2014 |
| JP | 2015-216053 | 12/2015 |
| JP | 2016-31802 | 3/2016 |
| JP | 2016-134308 | 7/2016 |
| KR | 10-2012-0135861 | 12/2012 |
| KR | 10-2014-0069327 | 6/2014 |

OTHER PUBLICATIONS

Espacenet English Abstract for Chinese Publication No. 103907169, published Jul. 2, 2014.
English Abstract for Chinese Publication No. 205230962, published May 11, 2016.
English Abstract for Japanese Publication No. 2016-134308, published Jul. 25, 2016.
Chinese Office Action dated Oct. 31, 2018 in Application No. 201710905319.2.
Chinese Patent Office Action dated May 17, 2019 in Application No. 201710905319.2.
S. Korean Office Action dated Jun. 18, 2018, in corresponding S. Korean Patent Application No. 10-2017-0126405, 4 pp.
Japanese Platform for Patent Information English abstract for Japanese Patent Application No. 2013-98126, dated May 20, 2013.
Japanese Platform for Patent Information English abstract for Japanese Patent Application No. 2014-63675, dated Apr. 10, 2014.
Japanese Platform for Patent Information English abstract for Japanese Patent Application No. 2013-37775, dated Feb. 21, 2013.
Japanese Platform for Patent Information English abstract for Japanese Patent Application No. 2010-44973, dated Feb. 25, 2010.
Japanese Platform for Patent Information English abstract for Japanese Patent Application No. 2015-216053, dated Dec. 3, 2015.
Japanese Platform for Patent Information English abstract for Japanese Patent Application No. 2016-31802, dated Mar. 7, 2016.
Japanese Platform for Patent Information English abstract for Japanese Patent Application No. 2012-199113, dated Oct. 18, 2012.
Japanese Platform for Patent Information English abstract for Japanese Patent Application No. 2011-108452, dated Jun. 2, 2011.
WIPO English abstract for Chinese Patent Publication No. 102820172A, published Dec. 12, 2012.
Extended European Search Report dated Mar. 5, 2018, in corresponding European Patent Application No. 17189817.4, 7 pgs.

* cited by examiner

ELECTROMAGNETIC RELAY

CROSS-REFERENCE TO RELATED APPLICATION

This application is based upon and claims the benefit of priority of the prior Japanese Patent Application No. 2016-197511 filed on Oct. 5, 2016, the entire contents of which are incorporated herein by reference.

FIELD

A certain aspect of the embodiments is related to an electromagnetic relay.

BACKGROUND

Conventionally, there has been known an electromagnetic relay in which a permanent magnet generates a magnetic field between contacts, and an arc that occurs between the contacts is extended by a Lorenz force and is extinguished (e.g. see Patent Document 1: Japanese Laid-open Patent Publication No. 2013-98126). Moreover, there has been known an electromagnetic relay in which a nonmagnetic body is arranged in a direction where an arc is extended by a permanent magnet (e.g. see Patent Document 2: Japanese Laid-open Patent Publication No. 2014-63675).

SUMMARY

According to an aspect of the present invention, there is provided an electromagnetic relay including: an electromagnet; a movable spring having a movable contact; a first terminal to which one end of the movable spring is connected; a second terminal having a fixed contact opposite to the movable contact; an actuator that rotates by excitation of the electromagnet, rotates the movable spring, and causes the movable contact to come in contact with the fixed contact or to separate from the fixed contact; a nonmagnetic card to be attached to the actuator; a plurality of magnetic members that sandwich the movable contact and the fixed contact, and apply a magnetic flux to the movable contact and the fixed contact to extend an arc; and a permanent magnet attached between the magnetic members.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the electromagnetic relay of the Patent Document 1, a card is in contact with the back of movable springs, and movable contacts on the movable springs are in contact with fixed contacts. In this structure, the movable springs are heated by an arc generated between the movable contacts and the fixed contacts, the card in contact with the movable springs may damage, i.e., the card may dissolve. When the card damages, a pressing force of the movable springs changes, and hence there is a possibility to worsen a contact state of the movable contacts and the fixed contacts.

A description will now be given of embodiments according to the present invention with reference to the drawings.

Figure 1:
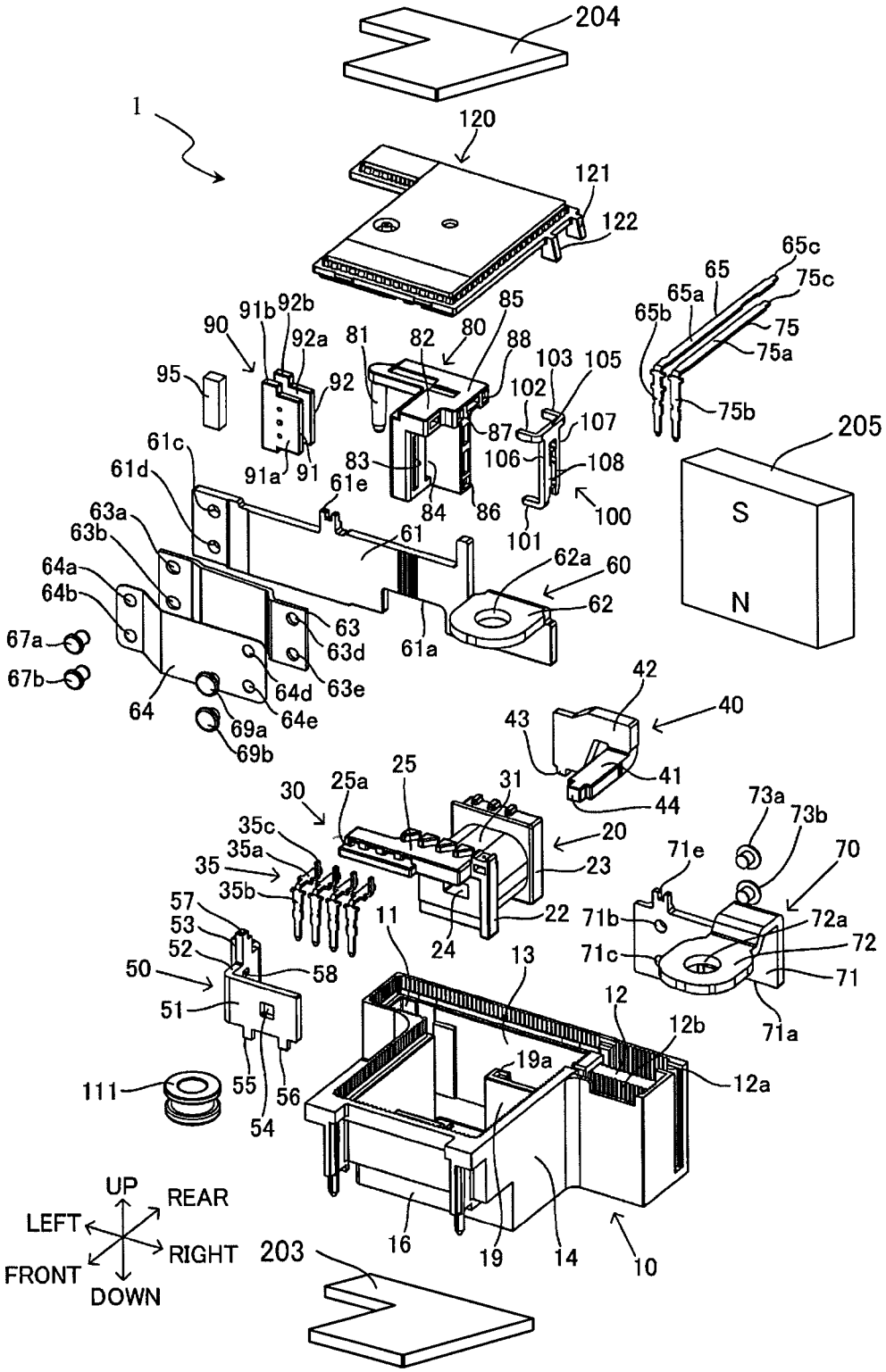
FIG. 1 is an exploded perspective view of a body part of an electromagnetic relay according to a present embodiment.
Figure 2:
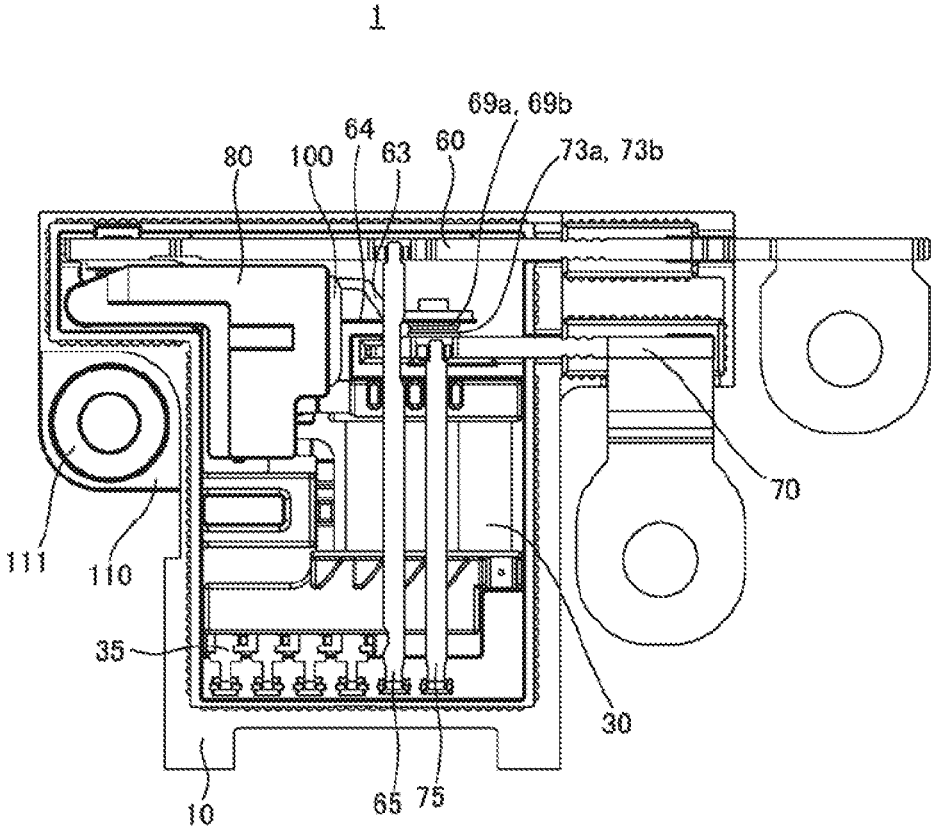
FIG. 2 is a plan view of the body part of the electromagnetic relay.
Figure 3:
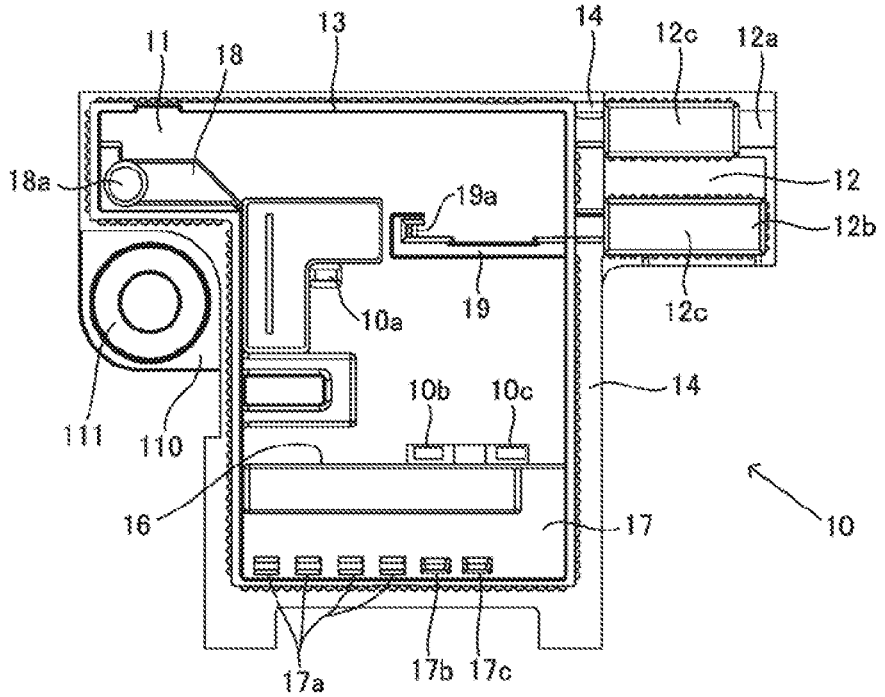
FIG. 3 is a plan view of a base.

FIG. 1 is an exploded perspective view of a body part of an electromagnetic relay according to a present embodiment. FIG. 2 is a plan view of the body part of the electromagnetic relay. FIG. 3 is a plan view of a base. In the following description, for convenience, up and down directions, front and rear directions, and right and left directions are defined as illustrated in FIG. 1.

A body part 1 of the electromagnetic relay according to the present embodiment is a polarized electromagnetic relay into which a permanent magnet 95 is incorporated, and makes first and second bus bar terminals 60 and 70, respectively, electrically conductive or non-conductive. Especially, a supply current from a vehicle battery flows between the bus bar terminals 60 and 70, and the body part 1 cuts off the supply of the current in an emergency. The bus bar terminal 60 functions as a movable terminal, and the bus bar terminal 70 functions as a fixed terminal.

The body part 1 includes a box-shaped base 10 which is opened upward. The base 10 is made of a resin mold, and has a planar shape including a central rectangular portion, a left extension portion 11 along a rear outer wall 13 and a right extension portion 12 along the rear outer wall 13. An expanded portion 110 is formed adjacent to the central rectangular portion and the left extension portion 11 (see FIG. 3), and a collar 111 is embedded in the expanded portion 110.

An upper opening of the base 10 is covered by a plate-like cover 120 made of a resin mold. The cover 120 has a roughly L-shape covering the central rectangular portion and the left extension portion 11 of the base 10. Projections 121 and 122 projecting downward are formed on a side of the cover 120 corresponding to the right extension portion 12 so as to press upper edges of plate parts 61 and 71 of the bus bar terminals 60 and 70, respectively.

The bus bar terminal 60 has the plate part 61 extending along an inner surface of the rear outer wall 13 of the base 10. A groove 12*a* having a slightly narrower width than the plate part 61 of the bus bar terminal 60 is formed on the right extension portion 12 of the base 10, and the bus bar terminal 60 is pushed into the groove 12*a*. That is, the bus bar terminal 60 is press-fitted into the groove 12*a* and fixed to the base 10. A left end of the plate part 61 of the bus bar terminal 60 extends to an end of the left extension portion 11 of the base 10. In the left extension portion 11 of the base 10, a gap is formed between the outer wall 13 and an inner wall part 18 having a hole 18*a* for attaching an actuator 80 described later, as illustrated in FIG. 3. The plate part 61 of the bus bar terminal 60 is sandwiched and held at this gap.

A protruding part 12*c* is formed on a bottom surface of the right extension portion 12 of the base 10. In the plate part 61 of the bus bar terminal 60, a cutout 61*a* is formed at a position corresponding to the protruding part 12*c*. Both edges extending in a vertical direction of the cutout 61*a* contact a vertical surface of the groove 12*a* along the protruding part 12*c* and an inner surface of an outer wall 14, so that the bus bar terminal 60 is positioned in the right and left direction, i.e., a horizontal direction.

The plate part 71 of the bus bar terminal 70 is press-fitted into a groove 12*b* of the right extension portion 12 of the base 10. Also, a cutout 71*a* is formed on the plate part 71 of the bus bar terminal 70. The cutout 71*a* contacts a vertical surface of the groove 12*b* along the protruding part 12*c* and an inner surface of the outer wall 14, so that the bus bar terminal 70 is positioned in the right and left direction, i.e., the horizontal direction.

Connection parts 62 and 72 that extend horizontally and are bent from the plate parts 61 and 71 are formed on the right ends of the bus bar terminals 60 and 70, respectively. The connection parts 62 and 72 have suitable structure to connect with feeding lines from the vehicle battery. In the example illustrated in FIG. 1, circular openings 62*a* and 72*a* are formed in the connection parts 62 and 72, and the bus bar terminals 60 and 70 can be connected to the feeding lines (not shown) by bolts.

An inner wall 19 extending to the interior of the base 10 from the outer wall 14 is formed in the base 10. A groove 19*a* extending in the vertical direction is formed on an end of the inner wall 19. A left end of the bus bar terminal 70 extends in the vicinity of the center of the base 10. The bus bar terminal 70 is disposed along the inner wall 19, and the left end of the bus bar terminal 70 is press-fitted into the groove 19*a*.

Two circular openings 61*c* and 61*d* arranged vertically are formed on the left end of the plate part 61 of the bus bar terminal 60. Also, two circular openings 63*a* and 63*b* arranged vertically are formed on a left end of a flat braided wire 63. Moreover, two circular openings 64*a* and 64*b* arranged vertically are formed on a left end of a movable spring 64. The flat braided wire 63 and the movable spring 64 are attached to the bus bar terminal 60 with the use of a rivet 67*a* passing through the openings 61*c*, 63*a* and 64*a* and a rivet 67*b* passing through the openings 61*d*, 63*b* and 64*b*.

Two circular openings 63*d* and 63*e* arranged vertically are formed on the right end of the flat braided wire 63. Two circular openings 64*d* and 64*e* arranged vertically are formed on the right end of the movable spring 64. The flat braided wire 63 and the movable spring 64 are coupled also at the right end by using a rivet-like movable contact 69*a* passing through the openings 63*d* and 64*d* and a rivet-like movable contact 69*b* passing through the openings 63*e* and 64*e*.

Two circular openings 71*b* and 71*c* arranged vertically are formed on the left end of the plate part 71 of the bus bar terminal 70. Rivet-like fixed contacts 73*a* and 73*b* are attached to the openings 71*b* and 71*c*, respectively. When the bus bar terminal $\mathbf{60}_1$ to which the flat braided wire 63 and the movable spring 64 are attached, and the bus bar terminal 70 are press-fitted into the base 10, the fixed contacts 73*a* and 73*b* are opposed to the movable contacts 69*a* and 69*b*, respectively. The movable contacts 69*a* and 69*b* of the movable spring 64 and the fixed contacts 73*a* and 73*b* of the bus bar terminal 70 function as contacts for switching the connection between the bus bar terminals 60 and 70 to a conductive state or a non-conductive state.

The bus bar terminals 60 and 70 are composed of pure copper, and the movable spring 64 is composed of a copper alloy having a spring characteristic. The bus bar terminals 60 and 70 are thicker than the movable spring 64, and have a heat capacity larger than that of the movable spring 64.

A wall 16 extending vertically to an intermediate height of the base 10 is formed on a front side of the base 10. Moreover, the base 10 is provided with a shallow bottom part 17 as a boundary of the wall 16 (see FIG. 3). An electromagnet part 30 in which a bobbin 20 made of a resin mold, an iron core 40 and a yoke 50 are combined is press-fitted between the wall 16 and the inner wall 19.

The bobbin 20 includes flanges 22 and 23, and a cylindrical part (not shown) coupling the flanges 22 and 23 with each other. A coil 31 is wound on the cylindrical part. The flanges 22 and 23 are rectangular in a front view, their bottom sides contact the bottom surface of the base 10, and the bobbin 20 is attached to the base 10 in a predetermined posture.

A through-hole 24 passing through the cylindrical part and the flanges 22 and 23 is formed in the bobbin 20, and a rod part 41 of the iron core 40 is inserted into the through-hole 24. The through-hole 24 and the rod part 41 have rectangular cross-sectional shapes corresponding to each other. Thereby, the iron core 40 is held so as to be a predetermined posture with respect to the bobbin 20.

A plate part 42 to be disposed parallel to the flange 23 is coupled with one end of the rod part 41 of the iron core 40. The plate part 42 extends in the left direction of FIG. 1 compared with the flange 23. A projection 43 to be fitted to the recess 10*a* formed on the bottom surface of the base 10 (FIG. 3) is formed on a left lower end of the plate part 42.

The yoke 50 has a base plate part 51 which is disposed parallel to the flange 22 of the bobbin 20. A through-hole 54 is formed on the base plate part 51. A projection 44 formed at one end of the rod part 41 of the iron core 40 is fitted to the through-hole 54 through the through-hole 24 of the bobbin 20. The through-hole 54 and the projection 44 have rectangular cross-sectional shapes corresponding to each other. Thereby, the yoke 50 is held so as to be a predetermined posture with respect to the iron core 40.

A left end of the base plate part 51 of the yoke 50 bends to the rear side, and extends to an intermediate plate part 52 extending parallel to the rod part 41 of the iron core 40. The intermediate plate part 52 bends to the left side again, and extends to a tip plate part 53 extending parallel to the flanges 22 and 23. The tip plate part 53 of the yoke 50 is opposed to the left end of the plate part 42 of the iron core 40. When a current flows in the coil 31, a magnetic field occurs between the tip plate part 53 of the yoke 50 and the plate part 42 of the iron core 40.

Projections 55 and 56 to be fitted respectively to recesses 10*b* and 10*c* (see FIG. 3) formed on the bottom surface of the base 10 are formed on a lower edge of the base plate part 51 of the yoke 50. A protrusion 57 to be fitted to a concave part (not shown) formed on a lower surface of the cover 120 is formed on an upper edge of the intermediate plate part 52. Moreover, a through-hole 58 is formed on the intermediate plate part 52. A fitting piece (not shown) extending vertically from the bottom surface of the base 10 is fitted into the through-hole 58 of the intermediate plate part 52.

Four coil terminals 35 are connected to the coil 31. The coil 31 generates the magnetic field in one direction when flowing the current to the two coil terminals 35, and generates the magnetic field in an opposite direction when flowing the current to the other two coil terminals 35.

A terminal holding part 25 to which the coil terminal 35 is attached is formed integrally on the bobbin 20. The terminal holding part 25 protrudes from the upper edge of the flange 22 to the front side, and extends to the left side from the flange 22. Four holes 25*a* into which one end of each coil terminal 35 is inserted are formed in one row on the left side of the terminal holding part 25.

Each coil terminal 35 includes a base plate part 35*a* that is inserted into the hole 25*a*, and a tip plate part 35*b* that bends downward from the front end of the base plate part 35*a*. The tip plate part 35*b* protrudes to the outside of the base 10 through each through-hole 17*a* formed on the bottom surface of the shallow bottom part 17 of the base 10 (see FIG. 3).

A rod part 35*c* extending in an upper direction is formed on the base plate part 35*a* of the coil terminal 35. The rod part 35*c* functions as a stopper when the coil terminal 35 is inserted into the hole 25*a*. The rod part 35*c* is connected to one end of the coil 31, not shown.

The four through-holes 17*a* into which the tip plate part 35*b* is inserted are formed on the shallow bottom part 17 of the base 10, and further two through-holes 17*b* and 17*c* are formed on the shallow bottom part 17 of the base 10 (see FIG. 3). Signal terminals 65 and 75 connected to the bus bar terminals 60 and 70, respectively, are inserted into the through-holes 17*b* and 17*c*. The signal terminals 65 and 75 are used when a relay control circuit, not shown, confirms a state of the contacts.

The signal terminal 65 includes a base plate part 65*a* extending horizontally, and a tip plate part 65*b* that bends from the base plate part 65*a*, extends downward and is inserted into the through-hole 17*b* of the base 10. A projection 65*c* is formed on one end of the base plate part 65*a*. A signal terminal fitting part 61*e* having a recess is formed on the upper edge of the plate part 61 of the bus bar terminal 60. The projection 65*c* of the base plate part 65*a* is fitted to the signal terminal fitting part 61*e*. The signal terminal 75 includes a base plate part 75*a* extending horizontally, and a tip plate part 75*b* that bends from the base plate part 75*a*, extends downward and is inserted into the through-hole 17*c* of the base 10. A projection 75*c* is formed on one end of the base plate part 75*a*. A signal terminal fitting part 71*e* having a recess is formed on the upper edge of the plate part 71 of the bus bar terminal 70. The projection 75*c* of the base plate part 75*a* is fitted to the signal terminal fitting part 71*e*.

The body part 1 further includes the actuator 80 switching the conductive state or the non-conductive state of the bus bar terminals 60 and 70 by a magnetic force generated by the electromagnet part 30. The actuator 80 is made of a resin mold, has an L-shaped planar shape, and functions as a driving unit. A shaft 81 extending downward is formed on the left end of the actuator 80. The shaft 81 is inserted into the hole 18*a* of the base 10, and hence the actuator 80 can rotate around the shaft 81.

An armature 90 is attached to an end 82 of the actuator 80. The armature 90 has a plurality of magnetic members in the form of two iron plate members 91 and 92. The two iron plate members 91 and 92 are fitted into holes 83 and 84 formed on the end 82 of the actuator 80, so that the iron plate members 91 and 92 are disposed parallel to each other and disposed to extend vertically. The iron plate members 91 and 92 are inserted from the left side of the end 82. The iron plate members 91 and 92 include flat parts 91*a* and 92*a* projecting from the right side of the end 82, and enlarged parts 91*b* and 92*b* extending upward from the flat parts 91*a* and 92*a*. The enlarged parts 91*b* and 92*b* are fitted into the holes 83 and 84 of the actuator 80, and hence the iron plate members 91 and 92 are fixed to the actuator 80.

The permanent magnet 95 is sandwiched between the enlarged parts 91*b* and 92*b* of the iron plate members 91 and 92, and is also held in a groove (not shown) formed on a left surface of the end 82 of the actuator 80. The iron plate members 91 and 92 are connected to poles of the permanent magnet 95, respectively. Therefore, a constant magnetic field is always formed between the flat part 91*a* of the iron plate member 91 and the flat part 92*a* of the iron plate member 92 which form a magnetic path.

Figure 4A:
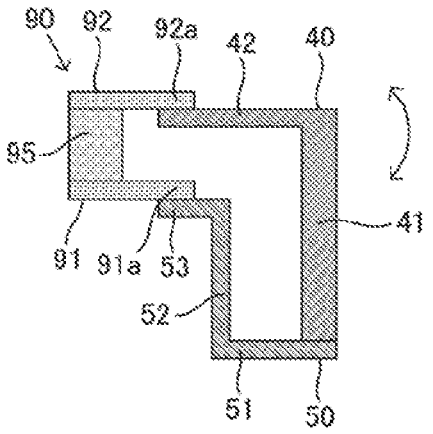
FIGS. 4A and 4B are views explaining a positional relationship between an armature, an iron core and a yoke.
Figure 4B:
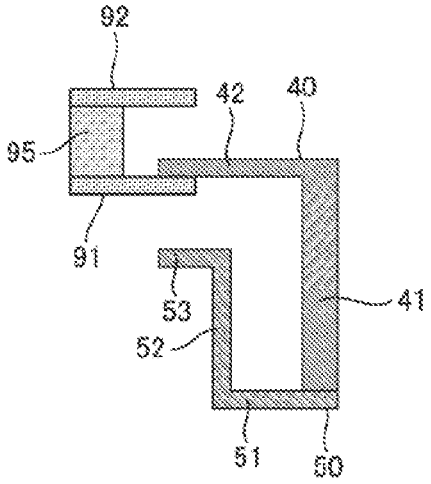

FIGS. 4A and 4B are views explaining a positional relationship between the armature 90, the iron core 40 and the yoke 50. In FIGS. 4A and 4B, the illustration of the actuator 80, the coil 31 and the like is omitted. In FIGS. 4A and 4B, the armature 90 is illustrated so as to perform a parallel movement. However, since the actuator 80 rotates, strictly speaking, the armature 90 is also slightly rotated as illustrated by an arrow.

As illustrated in FIG. 4A, the flat part 91*a* of the iron plate member 91 is disposed between the plate part 42 of the iron core 40 and the tip plate part 53 of and the yoke 50. Due to the interaction of the magnetic field generated between the flat parts 91*a* and 92*a* by the permanent magnet 95, and the magnetic field generated between the plate part 42 of the iron core 40 and the tip plate part 53 of the yoke 50 by the coil 31, a force is applied to the armature 90. Thereby, a force is applied to the actuator 80 via the armature 90, and hence the actuator 80 rotates. By changing a direction of the magnetic field generated by the coil 31 (i.e., a direction of an energizing current flowing through the coil 31) with respect to a direction of the magnetic field generated in the armature 90 by the permanent magnet 95, a direction of the force applied to the armature 90 can be any one of an up-direction and a down-direction of FIG. 4A.

By applying the force downward to the armature 90, the flat part 91*a* contacts the tip plate part 53 of the yoke 50 and the flat part 92*a* contacts the plate part 42 of the iron core 40, as illustrated in FIG. 4A. That is, the actuator 80 is rotated so that the armature 90 is in a position illustrated in FIG. 4A. When the armature 90 is disposed as illustrated in FIG. 4A, the magnetic force in which the flat parts 91*a* and 92*a* are attracted to the plate part 42 and the tip plate part 53 works by the permanent magnet 95. Therefore, the armature 90 is disposed as illustrated in FIG. 4A by the energization of the coil 31, and when the energization of the coil 31 is finished, the armature 90 is held at the position of FIG. 4A by the magnetic force generated by the permanent magnet 95.

By applying the force upward to the armature 90, the flat part 91*a* moves so as to contact the plate part 42 of the iron core 40, as illustrated in FIG. 4B. That is, the actuator 80 is rotated so that the armature 90 is in a position illustrated in FIG. 4B. The armature 90 is disposed as illustrated in FIG. 4B by the energization of the coil 31, and when the energization of the coil 31 is finished, the armature 90 is held at the position of FIG. 4B by the magnetic force generated by the permanent magnet 95.

Returning to FIG. 1, the actuator 80 has a protruding part 85 protruding from the end 82 to the right side. The protruding part 85 includes recess parts 86 to 88 for attaching a card 100. The card 100 transmits rotational operation of the actuator 80 to the movable contacts 69*a* and 69*b*. Moreover, the card 100 is composed of a nonmagnetic body, and absorbs the heat of an arc generated between the movable contacts 69*a* and 69*b* and the fixed contacts 73*a* and 73*b*. The nonmagnetic body is metal such as copper, aluminum, stainless steel and silver, or ceramics such as alumina.

The card 100 includes an upper edge part 105 extending the upper end of the card 100 horizontally, and projections 102 and 103 that are formed on both ends of the upper edge part 105 and fitted into the recess parts 87 and 88 of the actuator 80. Two vertical pieces 106 and 107 extend downward from the upper edge part 105, and a projection 101 to be fitted into the recess part 86 of the actuator 80 is formed on the lower end of the vertical piece 106. Convex parts 108 are formed on surfaces of the vertical pieces 106 and 107 which are opposite to each other, and the movable spring 64 is sandwiched between the convex part 108 of the vertical piece 106 and the convex part 108 of the vertical piece 107.

Thus, since the movable spring 64 is sandwiched by the card 100 attached to the actuator 80, the movable spring 64 and the movable contacts 69*a* and 69*b* attached to the movable spring 64 are moved depending on the rotation of the actuator 80. As a result, when the armature 90 is in the position illustrated in FIG. 4A, the movable contacts 69*a* and 69*b* are in contact with the fixed contacts 73*a* and 73*b*, and the bus bar terminals 60 and 70 are in the conductive state. On the other hand, when the armature 90 is in the position illustrated in FIG. 4B, the movable contacts 69*a* and 69*b* are separated from the fixed contacts 73*a* and 73*b*, and the bus bar terminals 60 and 70 are in the non-conductive state.

Figure 5:
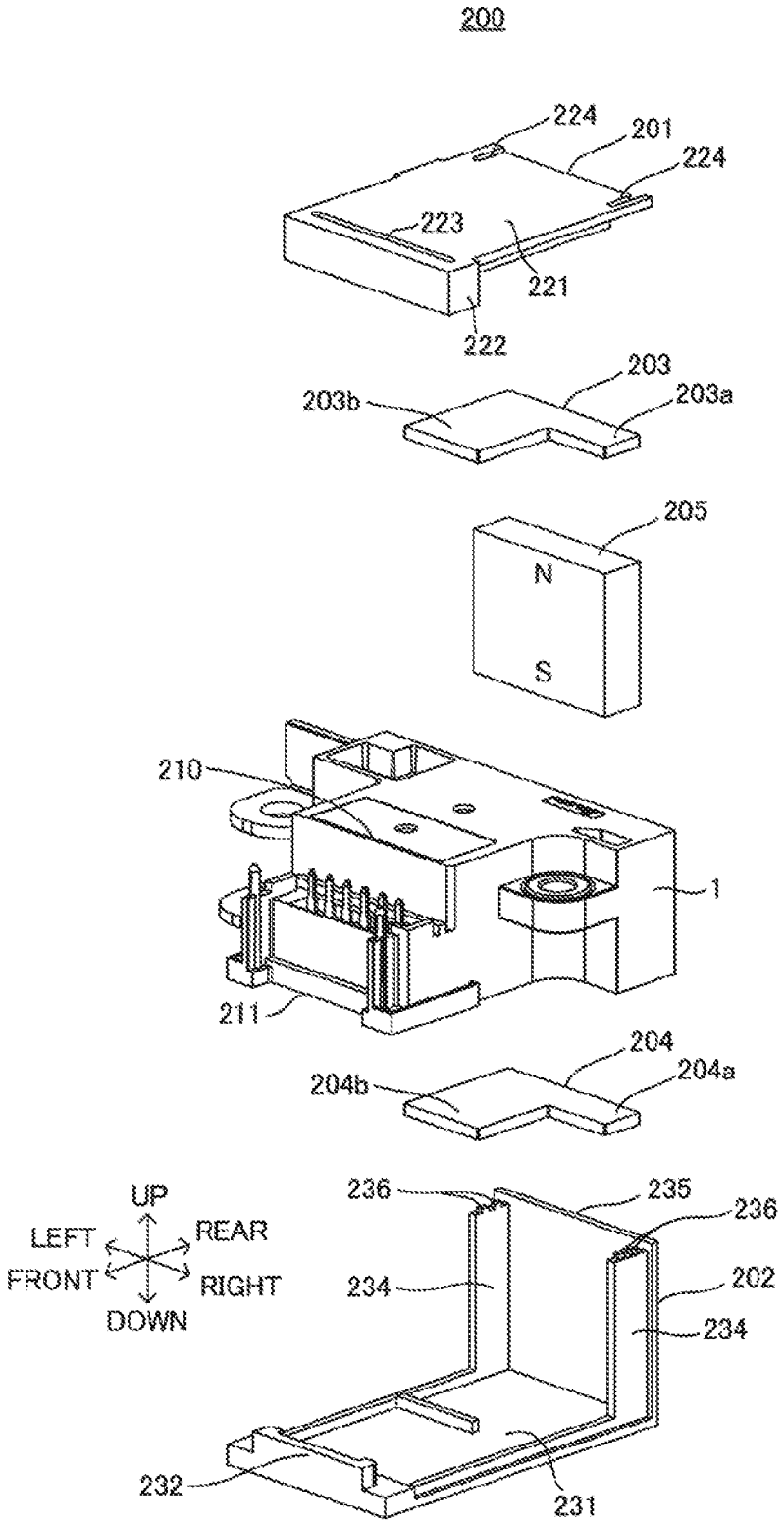
FIG. 5 is an exploded perspective view of the electromagnetic relay according to the present embodiment.
Figure 6:
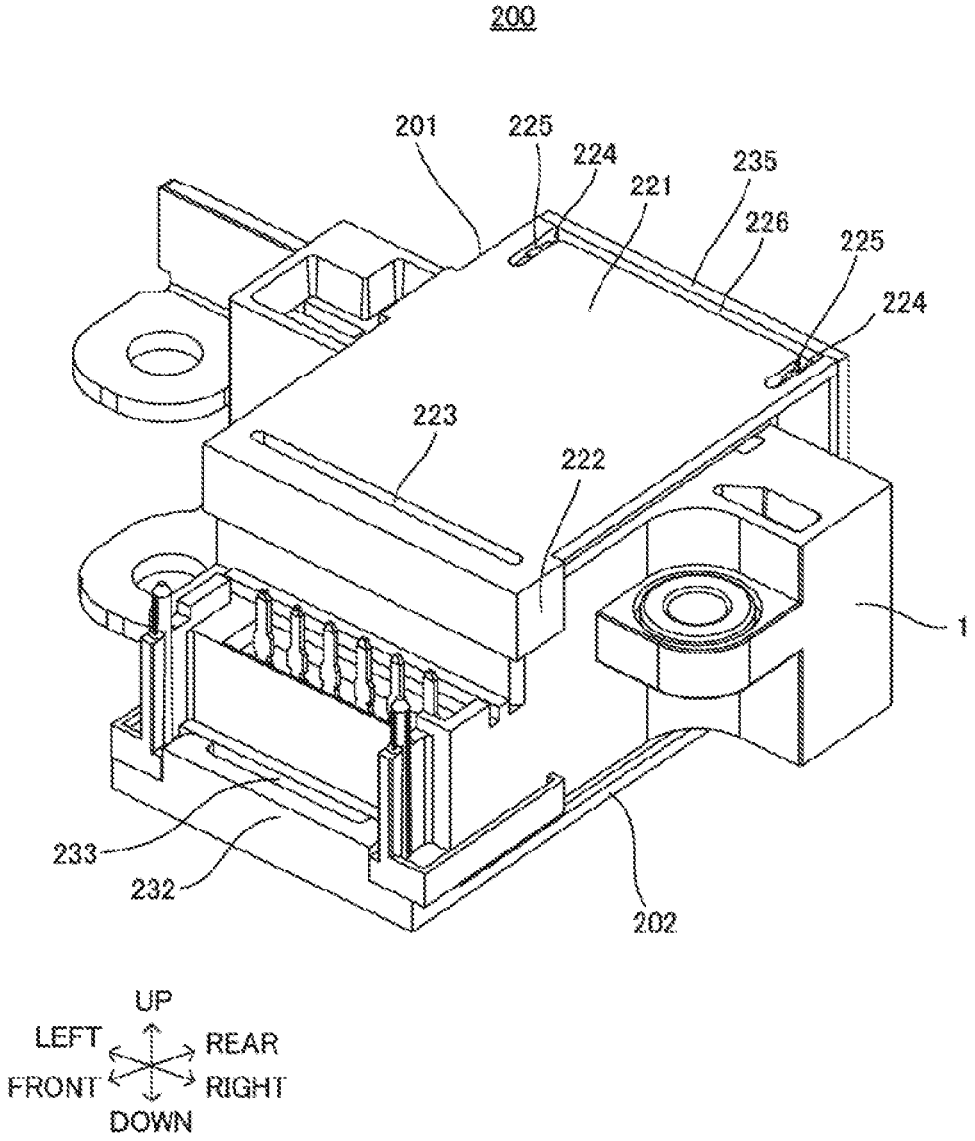
FIG. 6 is a perspective view of the electromagnetic relay.
Figure 7A:
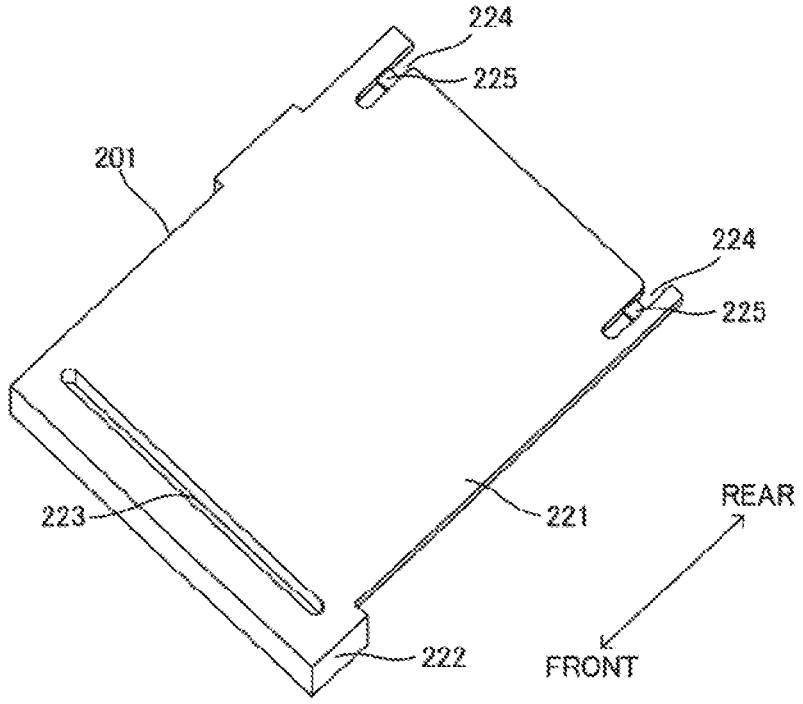
FIG. 7A is a perspective view of a first cover.
Figure 7B:
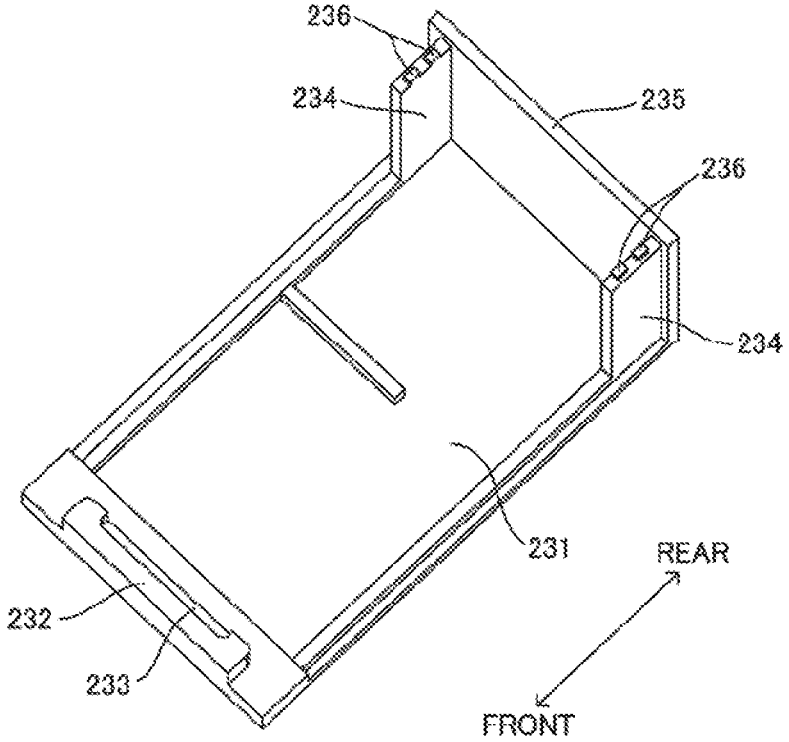
FIG. 7B is a perspective view of a second cover.

FIG. 5 is an exploded perspective view of the electromagnetic relay according to the present embodiment. FIG. 6 is a perspective view of the electromagnetic relay. FIG. 7A is a perspective view of a first cover, and FIG. 7B is a perspective view of a second cover. Here, the body part 1 of FIGS. 5 and 6 represents a state of reversing vertical and horizontal directions of the body part 1 of FIG. 1. In the following description, for convenience, up and down directions, front and rear directions, and right and left directions are defined as illustrated in FIGS. 5 to 7.

An electromagnetic relay 200 includes the body part 1, a first cover 201, a second cover 202, a first yoke 203, a second yoke 204, and a permanent magnet 205. One end of the permanent magnet 205 near the first yoke 203 is an N-pole, and the other end of the permanent magnet 205 near the second yoke 204 is an S-pole. The first yoke 203 is made of L-shaped iron. The first yoke 203 includes a flat part 203*a* bonded to the top of the permanent magnet 205, and an extending part 203*b* extending forward from the flat part 203*a*. The second yoke 204 is also made of L-shaped iron. The second yoke 204 includes a flat part 204*a* bonded to the bottom of the permanent magnet 205, and an extending part 204*b* extending forward from the flat part 204*a*. Each of the first yoke 203 and the second yoke 204 functions as a magnetic member.

The extending part 203*b* and 204*b* are opposed to the fixed contacts 73*a* and 73*b* and the movable contacts 69*a* and 69*b*, and sandwich the fixed contacts 73*a* and 73*b* and the movable contacts 69*a* and 69*b*. Since the first yoke 203 and the second yoke 204 sandwich the permanent magnet 205, a magnetic flux is generated toward the extending part 204*b* from the extending part 203*b*, and hence the magnetic flux can be intensively applied toward the fixed contacts 73*a* and 73*b* and the movable contacts 69*a* and 69*b*. Therefore, an arc-extinguishing performance can be improved by the first yoke 203 and the second yoke 204, and the permanent magnet 205 can be reduced in size.

The first cover 201 includes: a flat part 221; a hanging part 222 extending downward from a front end of the flat part 221; a through-hole 223 formed on a boundary between the flat part 221 and the hanging part 222; cut parts 224 formed on rear right and rear left end parts of the flat part 221; and a coupling part 225 coupling cut places with each other formed in each cut part 224 (see FIG. 7A). A gap 226 is formed between a rear end of the flat part 221 and a rear surface 235 of the second cover 202, as illustrated in FIG. 6. The hanging part 222 contacts an upper front end 210 of the body part 1 of FIG. 5, and performs positioning of the front and rear directions of the first cover 201.

The second cover 202 includes: a bottom surface 231; a protruding part 232 protruding upward from a front end of the bottom surface 231; the rear surface 235 extending upward from a rear end of the bottom surface 231; and right and left side surfaces 234 formed in an L-shape along the bottom surface 231 and the rear surface 235. The permanent magnet 205 is disposed between portions of the right and left side surfaces 234 along the rear surface 235.

Moreover, two projections 236 are formed on the top of each of the right and left side surfaces 234. The two projections 236 enters the cut part 224 of the first cover 201, and sandwiches the coupling part 225 of the first cover 201. Thereby, the first cover 201 is fixed to the second cover 202. Here, in order not to prevent the filling of an adhesive described later, each projection 236 has a height that does not protrude from an upper surface of the first cover 201.

A rear end of the protruding part 232 contacts a lower front end 211 of the body part 1, and performs positioning of the front and rear directions of the body part 1. A recess part 233 is formed on a rear end of the protruding part 232, as illustrated in FIG. 7B. Therefore, the recess part 233 is formed in front of the first cover 201 and the body part 1 so as not to overlap the first cover 201 and the body part 1 in an upper view.

A thermosetting adhesive is filled in the through-hole 223, the cut part 224, the gap 226 and the recess part 233, and the body part 1 is fixed between the first cover 201 and the second cover 202. Since the through-hole 223, the cut part 224, the gap 226 and the recess part 233 are arranged so as not to overlap with each other in the upper view, the thermosetting adhesive can be filled from above (i.e., from one direction), and the body part 1 can be fixed to the first cover 201 and the second cover 202 at a time.

Figure 8:
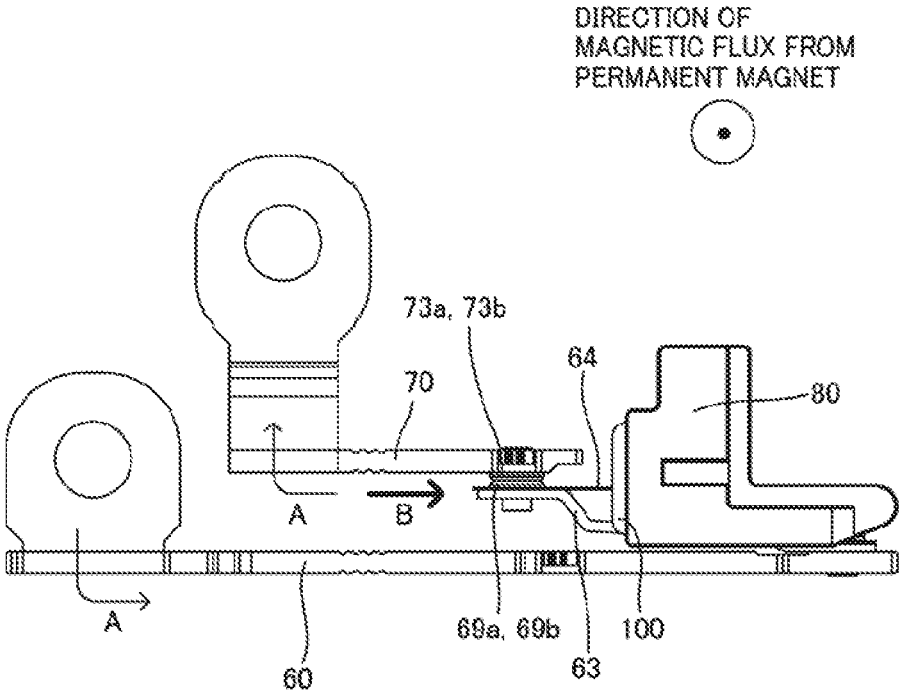
FIG. 8 is a diagram illustrating a positional relationship between bus bar terminals, a flat braided wire, a movable spring and an actuator.

FIG. 8 is a diagram illustrating a positional relationship between bus bar terminals 60 and 70, the flat braided wire 63, the movable spring 64 and the actuator 80.

In the present embodiment, the bus bar terminal 60 is connected to an anode (+), the bus bar terminal 70 is connected to a cathode (−), and the current flows in a direction of an arrow A of FIG. 8. A direction of the magnetic flux from the permanent magnet 205 is a vertical upward direction against FIG. 8. The arc generated between the movable contacts 69*a* and 69*b* and the fixed contacts 73*a* and 73*b* is extended in a direction of an arrow B by Fleming's left-hand rule.

The arc extended in the direction of the arrow B contacts the nonmagnetic card 100, the card 100 absorbs a thermal energy of the arc, and therefore the arc can be easily extinguished. Moreover, the card 100 is resistant to heat as compared with a card made of synthetic resin, and it is therefore possible to prevent a failure due to the heat of the arc. Thus, the card 100 has a function of cooling and extinguishing the arc and a function of protecting the actuator 80 from the heat of the arc in addition to a function of pressing the movable spring 64.

When a material of the card 100 is a magnetic body such as iron, the card 100 absorbs the magnetic flux from the permanent magnet 205, and therefore there is a possibility that a performance extending the arc decreases. For this reason, in the present embodiment, the card 100 is composed of the nonmagnetic body.

In the present embodiment, the bus bar terminal 70 to which the fixed contacts 73*a* and 73*b* are attached has a heat capacity larger than that of the movable spring 64 to which the movable contacts 69*a* and 69*b* are attached, and the current flows from the movable contacts 69*a* and 69*b* to the fixed contacts 73*a* and 73*b*. That is, the movable contacts 69*a* and 69*b* are an anode side, and the fixed contacts 73*a* and 73*b* are a cathode side.

When the arc is extended by the magnetic flux, the anode side is different from the cathode side in the behavior of the arc. An arc end of the anode side moves in a direction where the arc is extended, but the arc end of the cathode side agglutinates.

The movable contacts 69*a* and 69*b* are fixed to the movable spring 64 having a thermal capacity smaller than that of the bus bar terminal 70, which makes it difficult to release the heat generated by the arc. Therefore, the movable contacts 69*a* and 69*b* tend to intensely wear compared with the fixed contacts 73*a* and 73*b*. For this reason, the movable contacts 69*a* and 69*b* are set to the anode side where the arc end is easy to move. When the arc is extended, the arc end is moved from the movable contacts 69*a* and 69*b* to the movable spring 64, and hence the wear of the movable contacts 69*a* and 69*b* can be reduced.

Figure 9A:
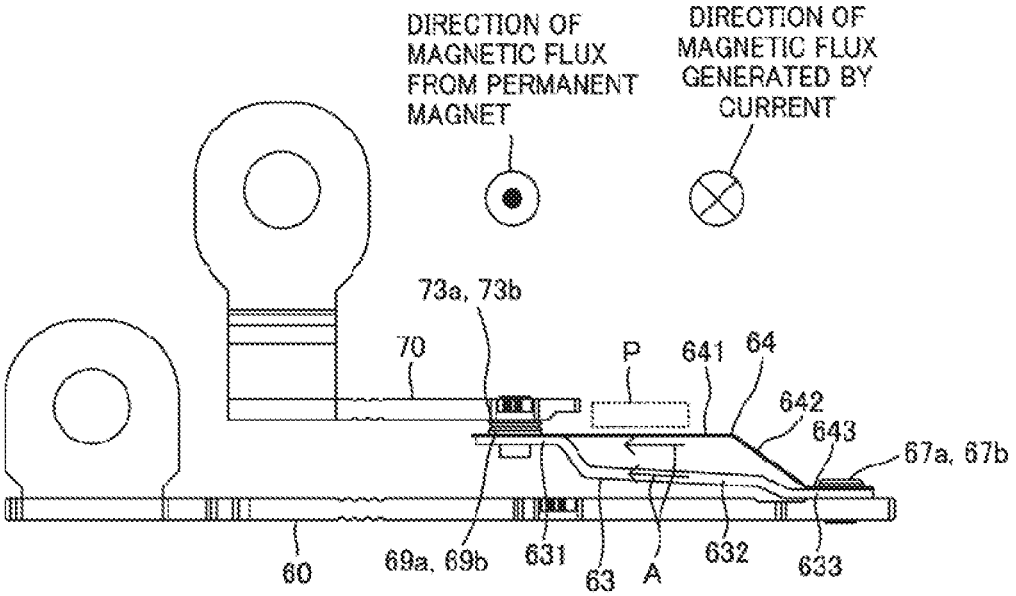
FIG. 9A is a diagram illustrating a positional relationship between the bus bar terminals, the flat braided wire and the movable spring.
Figure 9B:
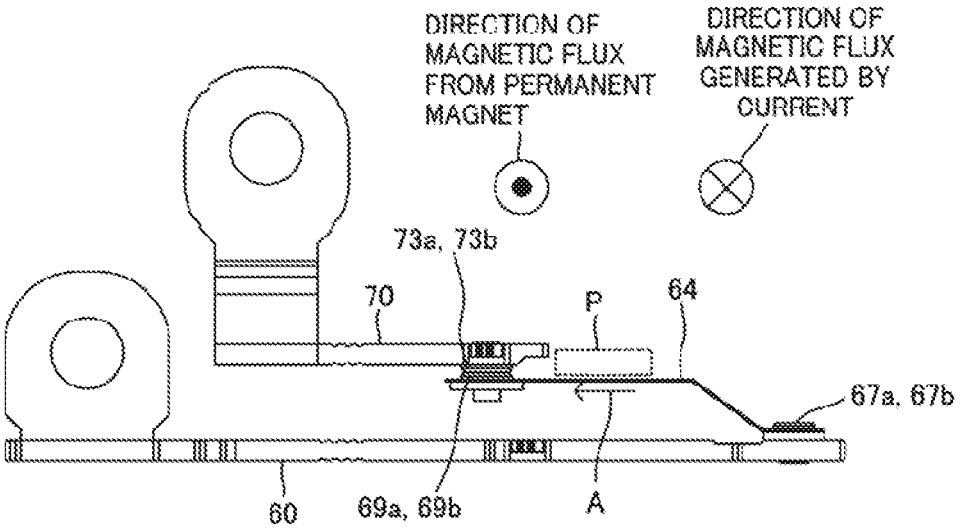
FIG. 9B is a diagram illustrating a positional relationship between the bus bar terminals and the movable spring.

FIG. 9A is a diagram illustrating a positional relationship between the bus bar terminals 60 and 70, the flat braided wire 63 and the movable spring 64. FIG. 9B is a diagram illustrating a positional relationship between the bus bar terminals 60 and 70 and the movable spring 64.

As illustrated in FIG. 9A, the movable spring 64 includes: a flat part 641 to which the movable contacts 69*a* and 69*b* are attached; a flat part 643 to which the rivets 67*a* and 67*b* are attached; and an inclination part 642 that connects the flat parts 641 and 643 to each other. The flat braided wire 63 includes: a flat part 631 to which the movable contacts 69*a* and 69*b* are attached; a flat part 633 to which the rivets 67*a* and 67*b* are attached; and a crank part 632 that connects the flat part 641 and 643 to each other and has a plurality of crank-like steps. The crank part 632 is away from the flat part 641 and the inclination part 642 through a space.

The movable spring 64 and the flat braided wire 63 are arranged side by side through the space, and the current flows in both of the movable spring 64 and the flat braided wire 63.

In a space P for extending the arc, a direction of the magnetic flux from the permanent magnet 205 is a vertical upward direction against FIGS. 9A and 9B, and a direction of the magnetic flux generated by the current flowing through the movable spring 64 is a vertical downward direction against FIGS. 9A and 9B. Therefore, a phenomenon that the magnetic flux generated by the current cancels the magnetic flux from the permanent magnet 205 occurs.

Especially, in FIG. 9B, since a distance between the space P for extending the arc and a current path (i.e., the movable spring 64) is short, a magnetic flux density due to the current flowing in the movable spring 64 becomes high in the space P for extending the arc, and an effect canceling the magnetic flux from the permanent magnet 205 becomes strong.

On the other hand, in FIG. 9, the current path is divided into a path passing through the movable spring 64 and a path passing through the flat braided wire 63. In the case of the path passing through the flat braided wire 63, the distance between the space P for extending the arc and the current path (i.e., the flat braided wire 63) can be increased, and it is therefore possible to reduce the magnetic flux density due to the current flowing through the flat braided wire 63 in the space P for extending the arc. In the case of the path passing through the movable spring 64 of FIG. 9A, the distance between the space P for extending the arc and the current path (i.e., the movable spring 64) is the same as that of FIG. 9B, but the current flowing through the movable spring 64 is smaller than that of FIG. 9B. Therefore, it is possible to reduce the magnetic flux density due to the current flowing through the movable spring 64 in the space P for extending the arc. Therefore, it is possible to suppress that the magnetic flux generated by the current cancels the magnetic flux from the permanent magnet 205.

Since the current flows through both of the movable spring 64 and the flat braided wire 63 in FIG. 9A, it is preferable that the flat braided wire 63 has a conductivity higher than that of the movable spring 64. Thereby, the current flowing through the flat braided wire 63 increases more than the current flowing through the movable spring 64, and it is therefore possible to reduce the effect canceling the magnetic flux from the permanent magnet 205 more effectively.

Figure 10:
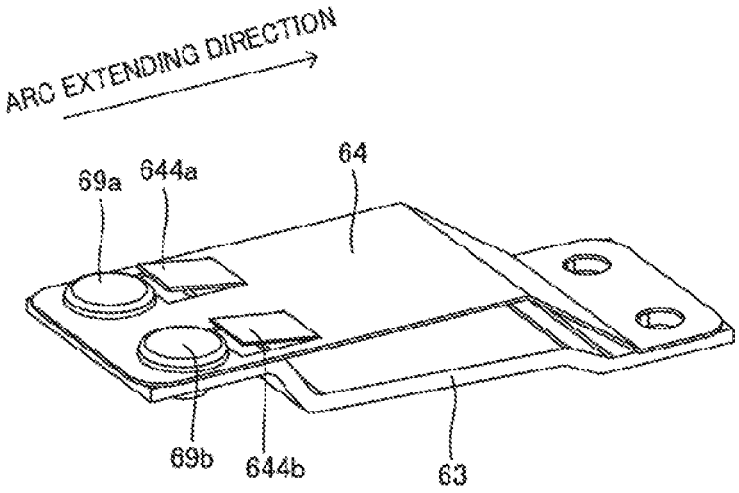
FIG. 10 is a diagram illustrating a variation of the movable spring.

FIG. 10 is a diagram illustrating a variation of the movable spring 64. As illustrated in FIG. 10, the movable spring 64 may include cut-and-raised parts 644*a* and 644*b* in the vicinity of the movable contacts 69*a* and 69*b* along an arc extending direction. Thereby, the arc end is easy to move from the movable contacts 69*a* and 69*b* to the movable spring 64, and it is possible to reduce the wear of the movable contacts 69*a* and 69*b*.

As described above, according to the present embodiment, the arc generated between the movable contacts 69*a* and 69*b* and the fixed contacts 73*a* and 73*b* is extended toward the nonmagnetic card 100 by the magnetic flux from the permanent magnet 205 via the first yoke 203 and the second yoke 204, and the nonmagnetic card 100 absorbs the heat of the arc and extinguishes the arc. Therefore, it is possible to avoid a failure of the electromagnetic relay due to the heat of the arc and improve the arc-extinguishing performance.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. An electromagnetic relay comprising:

an electromagnet;

a movable spring having a movable contact;

a first terminal to which one end of the movable spring is connected;

a second terminal having a fixed contact opposite to the movable contact;

an actuator that rotates by excitation of the electromagnet, rotates the movable spring, and causes the movable contact to come in contact with the fixed contact or to separate from the fixed contact;

a nonmagnetic card to be attached to the actuator;

a plurality of magnetic members that sandwich the movable contact and the fixed contact, and apply a magnetic flux to the movable contact and the fixed contact to extend an arc; and a permanent magnet attached between the plurality of magnetic members.

2. The electromagnetic relay as claimed in claim 1, wherein the second terminal has a heat capacity larger than that of the movable spring, and a current flows from the movable contact to the fixed contact.

3. The electromagnetic relay as claimed in claim 1, further comprising:

a flat braided wire that is arranged side by side with the movable spring through a space, and has a conductivity higher than that of the movable spring.

4. The electromagnetic relay as claimed in claim 1, further comprising:

a case that houses the electromagnet, the movable spring, the first terminal, the second terminal, the actuator and the card; and a first cover and a second cover that cover the magnetic members, the permanent magnet and the case.

5. The electromagnetic relay as claimed in claim 4, wherein the first cover includes a through-hole that fills an adhesive fixing the first cover to the case, and a cut part that fills an adhesive and fixes the second cover, the second cover includes a recess part that fills an adhesive fixing the second cover to the case, and the recess part is arranged so as not to overlap with the first cover and the case in an upper view.

* * * * *